US005326598A

United States Patent [19]

Seaver et al.

[11] Patent Number: 5,326,598

[45] Date of Patent: Jul. 5, 1994

[54] ELECTROSPRAY COATING APPARATUS AND PROCESS UTILIZING PRECISE CONTROL OF FILAMENT AND MIST GENERATION

[75] Inventors: Albert E. Seaver; William R. Berggren, both of Woodbury; Daniel R. Danielson, Oakdale; Eugene E. Harkins, Vadnais Heights; Ross M. Kedl, Roseville, all of Minn.

[73] Assignee: Minnesota Mining and Manufacturing Company, St. Paul, Minn.

[21] Appl. No.: 956,641

[22] Filed: Oct. 2, 1992

[51] Int. Cl.[5] ..... B05D 1/04; B05B 5/035

[52] U.S. Cl. ..... 427/473; 427/472; 118/626

[58] Field of Search ..... 118/626, 629; 427/475, 427/483, 472, 473; 239/3, 690, 697, 698

[56] References Cited

U.S. PATENT DOCUMENTS

| | | | |
|---|---|---|---|
| 2,695,002 | 11/1954 | Miller | 118/51 |
| 2,706,964 | 4/1955 | Ransburg et al. | 118/626 |
| 2,718,477 | 9/1955 | Miller | 427/483 |
| 2,723,646 | 11/1955 | Ransburg | 118/626 |
| 2,733,171 | 1/1956 | Ransburg | 239/3 |
| 2,809,128 | 10/1957 | Miller | 239/3 |
| 3,117,029 | 1/1964 | Hines | 118/621 |
| 4,435,261 | 3/1984 | Mintz et al. | 204/168 |
| 4,748,043 | 5/1988 | Seaver et al. | 427/30 |
| 4,749,125 | 6/1988 | Escallon et al. | 239/3 |
| 4,765,539 | 8/1988 | Noakes et al. | 239/3 |
| 4,770,738 | 9/1988 | Robillard | 156/608 |
| 4,788,016 | 11/1988 | Colclough et al. | 264/10 |
| 4,795,330 | 1/1989 | Noakes et al. | 425/6 |
| 4,826,703 | 5/1989 | Kisler | 118/626 |
| 4,830,872 | 5/1989 | Grenfell | 427/30 |
| 4,846,407 | 7/1989 | Coffee et al. | 239/690 |

FOREIGN PATENT DOCUMENTS 0186983 7/1986 European Pat. Off. .

OTHER PUBLICATIONS

Mitterauer, J., "Field Emission Electric Propulsion: Emission Site Distribution of Slit Emitters," *IEEE Transactions on Plasma Science*, vol. PS-15, No. 5, Oct. 1987, pp. 593-598.

Miller, E. P., *Electrostatics and Its Applications*, Chapter 11, "Electrostatic Coating," 1973, pp. 250-280.

Sample and Bollini, *Journal of Colloid and Interface Science*, vol. 41, No. 2, Nov. 1972, pp. 185-193.

Bracke, M. et al., *Progress in Colloid & Polymer Science*, 79:142-149, 1989, pp. 142-149.

*Primary Examiner*—Terry J. Owens

*Attorney, Agent, or Firm*—Gary L. Griswold; Walter N. Kirn; Robert H. Jordan

[57] ABSTRACT

An electrospray coating head system for applying thin coating to a substrate comprising a slot or blade to meter a liquid onto a shaping structure which forces the liquid to have a single continuous and substantially constant radius of curvature around the shaping structure. A voltage applied to the liquid around the shaping structure causes the liquid to produce a series of filaments which are spatially and temporally fixed, the number of filaments being defined by a simple adjustment in the applied voltage. The filaments break up into a uniform mist of charge droplets and are driven to a substrate by electric fields to produce a coating. Also a method for electrospray coating wherein liquid to be coated is dispensed from a metering portion to a lower shaping means where it achieves a single continuous and substantially constant radius of curvature, a voltage is applied to produce a series of filaments of the liquid which are spatially and temporally fixed, and the filaments break up into a uniform mist of charge droplets.

20 Claims, 5 Drawing Sheets

ELECTROSPRAY COATING APPARATUS AND PROCESS UTILIZING PRECISE CONTROL OF FILAMENT AND MIST GENERATION

FIELD OF THE INVENTION

This invention relates to a device for coating a continuous substrate and in one aspect to an apparatus and method for electrospraying a coating material onto a substrate.

BACKGROUND OF THE INVENTION

Electrostatic coating is usually obtained from a sprayhead that generates droplets in the range of about 10 micrometers (μm) to 500 μm. Most often the goal is to create a uniform coating that is several tens to several hundreds of micrometers thickness. For these coatings, droplets land on top of other droplets on a substrate and coalesce to form a continuous coating.

In conventional electrostatic spraying the droplets are generated from a liquid which, under electrical stress, dispenses the droplets from points of stress. Many of these electrostatic spraying processes generate droplets by first creating a liquid filament from each point of maximum electrical stress. When an electrostatic spraying process operates in this filament regime the operation can be further classified based on the flow rate in an individual filament of the liquid. At very low flow rates an electrospray mode occurs. In the electrospray mode the filament emanates from a liquid cone and the cone and filament can be fixed in space if the liquid cone is attached to a fixed structure such as the tip of a needle or other object. In the electrospray mode Rayleigh capillary or filament breakup is believed to occur, causing the tip of the filament to break up into a fine mist of droplets. As the flow rate to a filament is increased a flow rate is reached where the cone tip begins to take on a transparent look although the base of the liquid cone remains more opaque. Usually this can only be seen by use of an optical magnifier such as by viewing the liquid cone and filament through a cathetometer. This flow rate marks the beginning of the flow rate range where the filament operates in what is known as the harmonic spraying mode. If the flow rate of the filament is increased in the harmonic spraying mode the filament appears to become larger in diameter. Eventually, as the flow rate is increased further the transparency of the cone tip starts to disappear and with further increase in flow rate the filament becomes quite long and rather large in diameter. This flow rate where the transparency of the cone tip starts to disappear marks the beginning of the high flow rate mode. In summary, when an electrostatic spraying process is operated in the filament regime it can be classified according to its flow rate as operating either below, in, or above the harmonic spraying mode depending on the flow rate that occurs in a single filament. For a given liquid the actual flow rate range for the harmonic spraying mode is dependent on the liquid's properties, and especially the electrical conductivity. A large number of liquids useful in coating applications have their electrical conductivity in the range between 0.1 and 1000 microsiemens per meter ($10^{-7}$ and $10^{-3}$ S/m). For liquids in this conductivity range the most conductive liquids start harmonic spraying when the filament flow rate reaches around 0.1 to 1 milliliter per hour (ml/hr) whereas for the least conductive the harmonic spray mode does not first occur until the filament flow rate reaches around 10 to 100 ml/hr.

Sample and Bollini (Journal of Colloid and Interface Science Vol. 41, 1972, pp 185–193) describe the harmonic spraying cycle and point out that at the start of the cycle the electrically stressed liquid first becomes elongated. Then, the liquid forms a cone shape which then develops a filament of liquid from the tip of the cone. The liquid filament elongates or stretches, and finally the liquid filament snaps off of the cone shaped base. This last step produces a free liquid filament which, due to the surface tension force, becomes a droplet, and a cone shaped liquid which, due to the surface tension force, attempts to relax back to its original state. However, during the cone's relaxation the imposed electrical stress starts another cycle of harmonic spraying. When viewed with optical magnification, the cone appears as an opaque liquid hemisphere inside a partially transparent cone with a filament nearly fixed in place. The cone's transparent property is due to the fact that during a portion of the time there is actually nothing present in that space since the liquid is relaxing back after the filament of liquid snapped off. As suggested by Sample and Bollini, if care is taken to control the initial amount of liquid from which electrical harmonic spraying occurs then the droplets generated from the filaments can be fairly close in size. When the flow rate is increased above the range where harmonic spraying occurs the length of the filament increases and Rayleigh capillary (or filament) instability begins to compete as a mechanism for breaking the filament into droplets. At these higher flow rates long filaments and large droplets are produced. In conventional electrostatic atomization the flow rate is usually operated in either the harmonic spray mode or in the higher flow rate mode. However, if the flow rate becomes too high only streaks of liquid are produced. In conventional electrostatic spraying no special care is taken to insure the droplets are the same diameter. However, because the electrical stress is reasonably constant, the droplets produced usually have a tighter size distribution than found in most non-electrostatic spray devices.

If the flow rate in a conventional electrostatic sprayhead is reduced below the harmonic spraying mode while the speed of the object being coated remains the same, the coating thickness is reduced, and eventually, at a low enough flow rate the coating loses its uniformity. Close examination shows that while some filaments are being developed in the electrical harmonic spraying or pulsing mode, other filaments start to develop from liquid cones which temporarily become fixed in space. Although such a liquid cone and its filament becomes temporarily fixed, droplets are still generated from the filament tip. The liquid filament has fluid flow within it and for a certain flow rate range the filament is unstable. Subsequently, the filament tip breaks-up into droplets due to Rayleigh capillary or filament instability. At this low flow rate both the filament that is produced and its droplets have a diameter quite small compared to the filaments and droplets produced at the high flow rate mode. For liquids useful in industrial coating applications, this low flow rate range typically occurs below about 0.1 to 100 milliliters per hour per filament depending on the fluid properties, and this low flow rate mode is called the electrospray mode. The electrospray mode produces droplets having uniform diameter, i.e., a narrow size distribution, in the 1 to 50 μm size range depending on the properties of the liquid, the potential applied to the liquid and the flow rate. Whereas the high flow rate mode produces droplets typically above 50 μm in diameter, the electrospray mode produces a fine mist. In general, electrostatic atomization or electrostatic spraying from filaments can be defined to include the electrospray mode, the harmonic spraying mode, and the high flow rate mode. The electrospray mode is only practical when very low flow rates are desired, as for example to produce thin coatings.

U.S. Pat. No. 2,695,002 (Miller) describes the use of an electrostatic blade and teaches atomization of a liquid at the blade edge. Later, the same inventor disclosed a picture of a device purporting to generate evenly spaced filaments of liquid emanating from a blade tip (*Electrostatics and its Applications* (1973) pp 255–258). These filaments were designed to produce a mist of fine droplets and the blade was disclosed as a way to generate a series of filaments which operate in the electrospray mode and in the harmonic mode. Regardless of the disclosures, one skilled in the art quickly learns that these filaments tend to dance and drift in time. Indeed it is very difficult to keep the filaments both spatially and temporally fixed. Furthermore, two adjacent filaments can drift apart causing a decrease in the atomized mist at that location. Likewise, two adjacent filaments can drift together causing a temporary increase in the atomized mist at that location. When the mist is applied to a substrate, this can cause decrease or increase in the coating thickness respectively.

The present invention relates to an electrostatic spraying process which is unlike many conventional electrostatic processes which have been used for a number of years to make reasonably thick coatings, e.g., several tens to several hundreds of micrometers. The present invention can be used to make uniform coatings, either discontinuous or continuous as desired, between about one tenth and several tens of micrometers. The present invention can operate in a stable state in the electrospray range. The electrospray range refers to a restricted flow rate range where a single liquid filament can be generated and controlled to produce a uniform spray mist. The total flow rate is then the sum of the flow rates of the individual filaments produced. The electrospray range is useful for generating a mist that can be used to produce a thin film coating. However, for the coatings to be uniform the mist must be uniform, which requires the filaments to be both spatially and temporally fixed. Much of the recent patent art is dedicated to the development of sprayheads which attempt to meet this criteria. The recent patent art has attempted to fix the number of filaments by causing the spray to occur from a fixed number of points such as needles or teeth. For example, U.S. Pat. No. 4,748,043 (Seaver et al.) discloses the use of a low density series of needles to create the series of filaments needed to coat very thin coatings in an electrospray coating process. U.S. Pat. No. 4,846,407 (Coffee et al.) discloses placement along a blade a series of sharp pointed protrusions which resemble teeth to overcome the filament movement problem. U.S. Pat. No. 4,788,016 (Colclough et al.) discloses a non-conductive blade with teeth and U.S. Pat. No. 4,749,125 (Escallon et al.) discloses shims which have teeth-like structures from blunt to sharp. While these devices do fix the number of filaments, they severely restrict the range of coating that can be accomplished without mechanically changing the coating head. Furthermore, devices which are made with fixed points can, at a certain voltage, give rise to a loss of uniform mist when multiple filaments start to occur at one point and a single filament occurs at an adjacent point.

SUMMARY OF THE INVENTION

The invention provides an electrospray coating head system for use in an electrospray coating process. In brief summary, the coating head system comprises a metering portion for dispensing liquid to a lower shaping means and a lower shaping means for creating a single continuous and substantially constant radius of curvature of the metered liquid around the lower shaping means so that the number and position of liquid filaments extending from the lower shaping means is variable depending on the magnitude of a potential applied to the surface of the liquid surrounding the lower shaping means. At a specific potential, the liquid filaments are spatially and temporally fixed to permit generation of a uniform mist of highly charged droplets.

The invention also provides a method of variably controlling the uniform emission of the liquid being applied as a coating material in an electrospray coating process. The method, briefly summarizing, comprises the steps of providing a metering portion for dispensing liquid to a lower shaping means; positioning the lower shaping means for creating a single continuous and substantially constant radius of curvature of the metered liquid around the lower shaping means so that the number and position of liquid filaments extending from the lower shaping means is variable depending on the magnitude of a potential applied to the surface of the liquid surrounding the lower shaping means; and then adjusting the potential applied to the surface of the liquid so that a specific potential produces the desired number and position of filaments. At a specific potential the liquid filaments are spatially and temporally fixed to permit generation of a uniform mist of highly charged droplets. Finally, the method further comprises directing the flow of the mist toward selected deposition sites on a movable substrate.

BRIEF DESCRIPTION OF THE DRAWINGS

The invention will be further explained with reference to the drawings.

Figure 1:
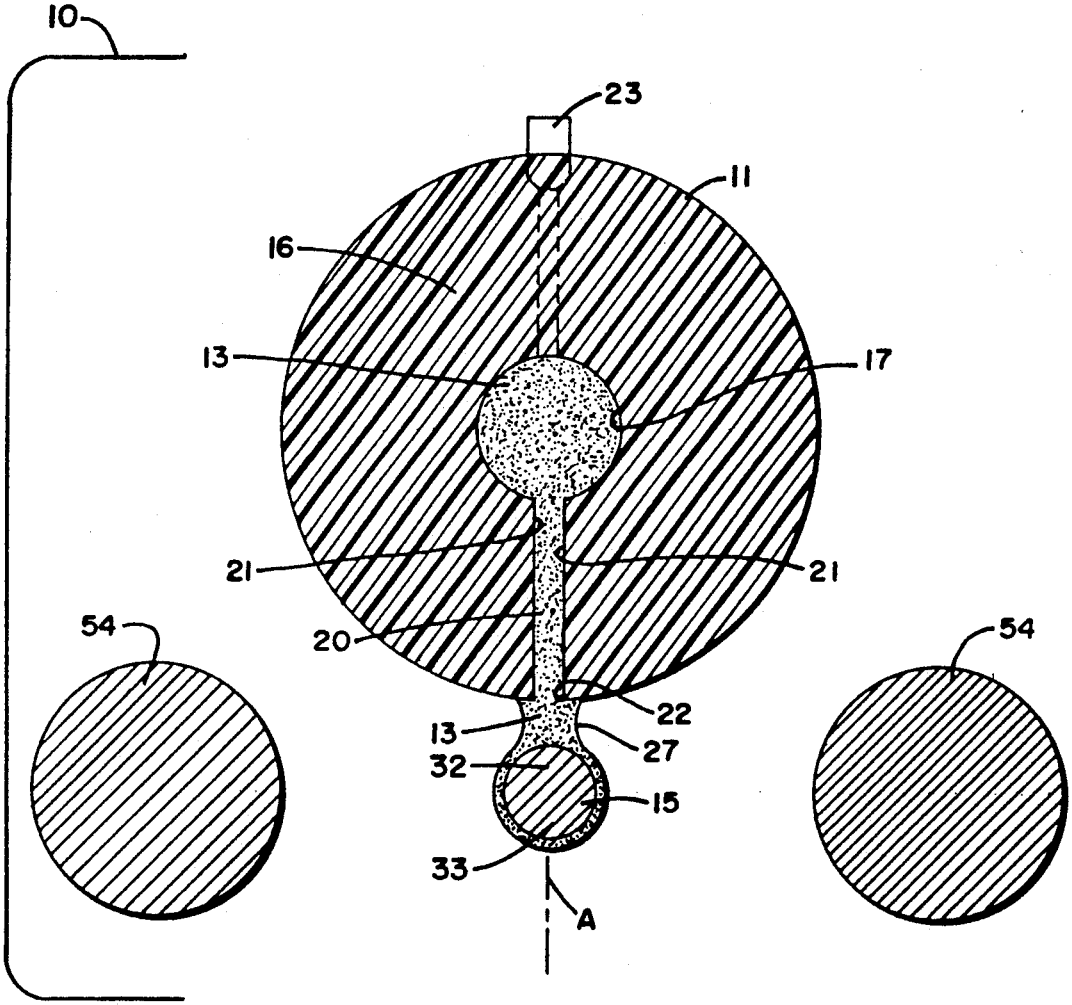
FIG. 1 is an end section view of a spray head assembly comprising metering means to create a liquid curtain and a uniform local radius of curvature of liquid around a lower shaping means.

These figures are not to scale and are intended to be merely illustrative and non-limiting.

DETAILED DESCRIPTION OF THE INVENTION

The invention relates to an electrospray process for efficiently applying coatings to substrates. While electrostatic spraying is the use of electric fields to create and act on charged droplets of the material to be coated so as to control the material application, it is normally practiced by applying heavy coatings of material such as paint spraying of parts. In this invention, electrospray describes the spraying of very fine droplets from a structure and directing a uniform mist of these droplets by action of electric fields onto substrates.

The coatings which are referred to in this invention include films of selected materials on substrates which are useful as primers, low adhesion back sizes, release coatings, lubricants, adhesives, and other materials. In some cases, only a few monomolecular layers of material are required. U.S. Pat. No. 4,748,043 discloses one means of applying such coatings at various thicknesses. The present invention provides a non-contacting method to accurately and uniformly apply a coating onto a substrate to any desired coating thickness from a fraction of a micrometer when operated in a single head configuration to hundreds of micrometers when operated in a multiple head configuration. A goal of this invention is the generation of a mist of material and the controlled application of that mist in a uniform manner onto a substrate to provide a controlled film coating of the material on the substrate. More specifically, it is an object of the present invention to create an electrospray coating head which creates and holds a series of liquid filaments spatially and temporally fixed to allow for a uniform coating. It is a further objective of the present invention to create an electrospray coating head which allows a change in droplet mist density by changing the number and position of filaments necessary to create the mist density without changing the mechanical dimensions or parts of the sprayhead. It is a further objective of the present invention to create an electrospray head which allows the number and position of the filaments to be changed by a simple adjustment of the applied voltage.

The liquid to be electrosprayed preferably has certain physical properties to optimize the process. The electrical conductivity should be between about $10^{-7}$ and $10^{-1}$ siemens per meter. If the electrical conductivity is much greater than $10^{-3}$ siemens per meter, the liquid flow rate in the electrospray becomes too low to be of practical value in many coating applications. If the electrical conductivity is much less than $10^{-7}$ siemens per meter, the liquid does not electrospray well.

The surface tension of the liquid to be electrosprayed (if in air at atmospheric pressure) is preferably below about 65 millinewtons per meter and more preferably below about 50 millinewtons per meter. If the surface tension is too high a corona will occur around the air at the liquid cone tip. This will cause a loss of electrospray control and can cause an electrical spark. The use of a gas different from air will change the allowed maximum surface tension according to the breakdown strength of the gas. Likewise, a pressure change from atmospheric pressure and the use of an inert gas to prevent a reaction of the droplets on the way to the substrate is possible. This can be accomplished by placing the electrospray generator in a chamber and the curing station could also be disposed in this chamber. A reactive gas may be used to cause a desired reaction with the liquid filament or droplets.

The viscosity of the liquid must be below a few thousand millipascal-seconds, and preferably below a few hundred millipascal-seconds. If the viscosity is too high, the filament will not break up into uniform droplets.

The dielectric constant and electrical conductivity define the electrical relaxation property of the liquid. However, since the conductivity can be adjusted over a wide range the dielectric constant is believed to be of lesser importance.

The electrospray process of the present invention has many advantages over the prior art. Because the coatings can be put on using little or no solvent, there is no need for large drying ovens and their expense, and there are less pollution and environmental problems. Indeed in the present invention, this small use of solvent means there is rapid drying (usually only curing of the coating is needed) and thus multiple coatings in a single process line can be obtained. Furthermore, porous substrates can be advantageously coated on one side only because there is little or no solvent available to penetrate to the opposite side.

If desired, additive formulations may be added to adjust the electrospray properties as desired. For example, methanol might be added to increase the conductivity and/or lower the viscosity of a material to be coated. Toluene might be added to lower the viscosity of a material to be coated. In addition, reactive agents may be added as solvents and also serve to impart desired properties to the resultant coating.

Figure 5:
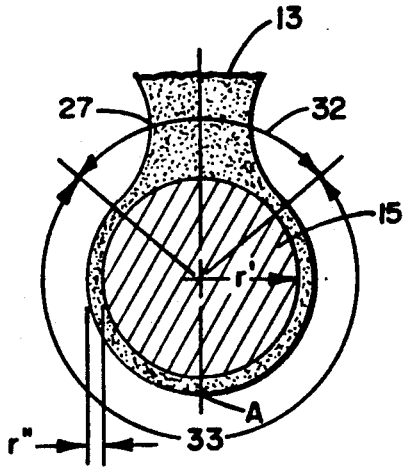
FIG. 5 is an enlarged sectional view of a lower shaping means with a first portion to receive a liquid and a second portion to create a continuous and constant radius of curvature.

Referring to FIG. 1, one embodiment of the electrospray coating head system 10 consists of a metering portion 11 for dispensing liquid 13 to a lower shaping means 15. Lower shaping means 15 is designed to receive liquid 13 at first portion 32 and to create a single continuous and substantially constant radius of curvature of the metered liquid 13 around second portion 33 of the lower shaping means. This permits the number and position of liquid filaments which extend from the second portion 33 of lower shaping means 15 during electrical operation of system 10 to be selectively variable. The variable feature is achieved by regulating the potential applied to the surface of liquid 13 surrounding lower shaping means 15. Also, lower shaping means second portion 33 shapes the liquid so that at a specific potential the liquid filaments are spatially and temporally fixed to permit generation of a uniform mist of highly charged droplets. Although lower shaping means 15 may comprise differently shaped members, or even a portion of another member, a preferred lower shaping means shape comprises an elongated wire-like member having a circular or near-circular cross section. Referring to FIG. 1 and FIG. 5, lower shaping means 15 preferably comprises first portion 32 for receiving liquid 13 from metering portion 11, and second portion 33 for creating a continuous and constant radius of curvature.

Figure 2:
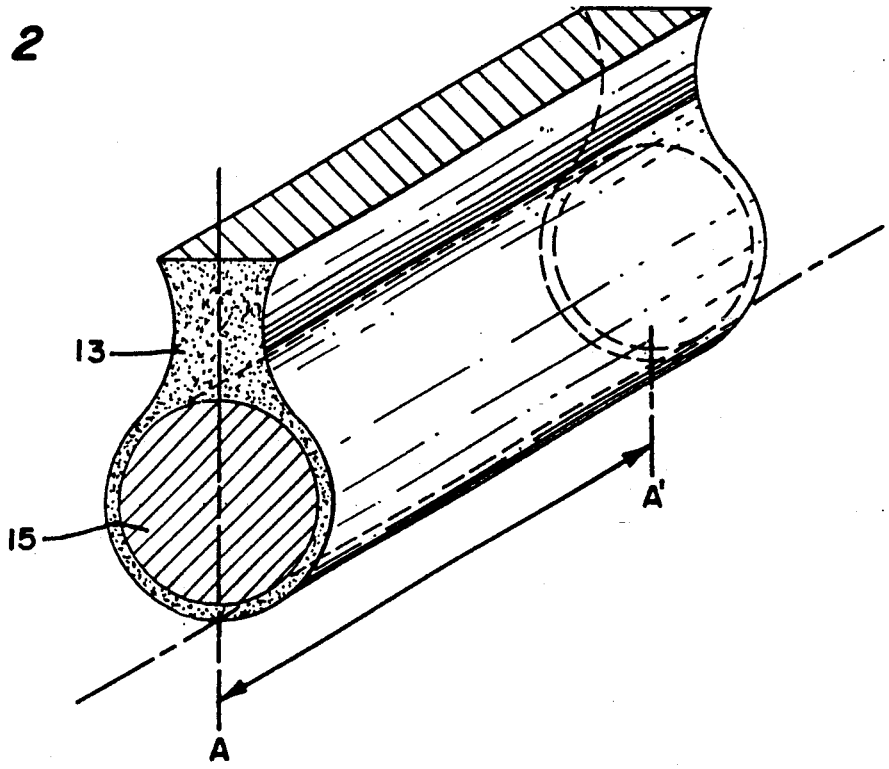
FIG. 2 is a perspective view of a liquid extending onto and around a lower shaping means.

In the embodiment of FIG. 1, metering portion 11 comprises an elongated tube 16 having a liquid reservoir cavity defined by cavity walls 17 which receives liquid 13 and then with pressure dispenses the liquid through a narrow slot 20, defined by walls 21. Liquid 13 then exits out of an external aperture 22 extending along a length of the metering portion. Liquid 13 flows toward lower shaping means 15 which is positioned beneath the metering portion. Lower shaping means 15 may be made of an electrically conducting, semiconducting, or insulating material. A preferred lower shaping means is made of a conducting material such as stainless steel to allow simple connection to a high voltage power supply and to allow easy placement of electrical charges at the surface of the liquid surrounding lower shaping means 15 and, especially, placement along line segment A–A', as shown in FIG. 2. Referring to FIG. 1 and FIG. 2, liquid 13 preferably flows out of metering portion 11 via slot 20 at a low flow rate. A liquid curtain 27 is then formed between the metering portion 11 and first portion 32 of lower shaping means 15. Other connections to a high voltage power supply are contemplated. For example, when a high voltage power supply is connected to a conductive fitting, such as liquid feed fitting 23, shown in FIG. 1, the electrical conductivity of the liquid is again used to transport the charges to the surface of the liquid around lower shaping means 15.

Figure 3:
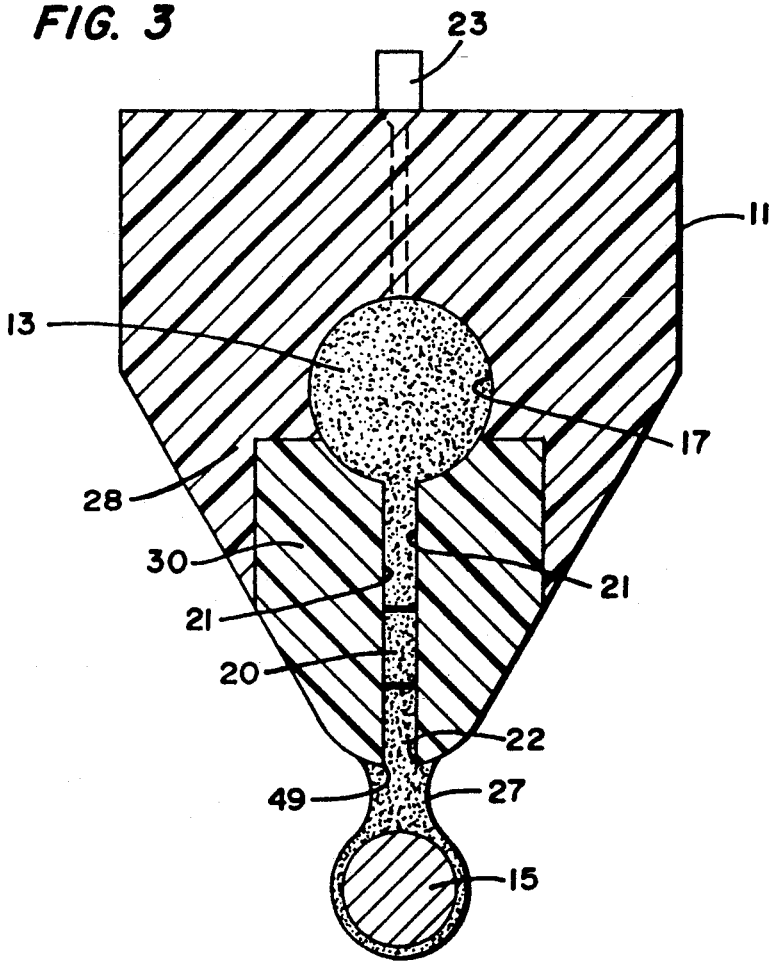
FIG. 3 is an end section view of a spray head assembly comprising metering means to create a liquid curtain and a continuous and constant radius of curvature of liquid around a lower shaping means.

In the embodiment of spray head system disclosed in FIG. 3, metering means 11 comprises a fixed upper section 28 and a removable and replaceable lower section 30 to more easily reconfigure the spray head system with different widths of slot 20 and aperture 22. It is within the scope of this invention that equivalent structures to slot 20 are contemplated and are described below.

Use of slot 20 within metering means 11, shown in FIG. 1, results in a uniform distribution of liquid 13 along a length of second portion 33 of lower shaping means 15. An electrical potential is created around the liquid on lower shaping means 15 in order to generate a uniform mist of highly charged droplets, as represented by droplets 34 in FIG. 4. First, however, when a high voltage is applied to the liquid on lower shaping means 15, an electric field is created which stresses the liquid at second portion 33 of lower shaping means 15, shown in FIG. 4 and FIG. 5, and especially along line segment A–A' shown in FIG. 2 and FIG. 5. At zero or low voltage, a few irregularly spaced hemispherical drops slowly swell and detach from the lower shaping means by their own weight. However, at a higher voltage, liquid 13 along line segment A–A' of lower shaping means 15 forms a series of evenly spaced cones 39, shown in FIG. 4. Each cone 39 emits a liquid filament 40 from its tip. The number of filaments can be increased by increasing the applied voltage. For a given total flow rate into the electrospray coating head system 10, the voltage is adjusted to produce enough filaments 40 such that the flow rate in an individual filament is within the electrospray range. With the filaments operating in the electrospray range, the tips of filaments 40 then disrupt into a continuous series of tiny charged droplets which are directed by electric fields to a moving substrate 43.

Previous attempts at controlling the pattern of electrospray droplets from a smooth, uniform and linearly straight surface have failed to prevent the formation of unwanted filaments, or to prevent the movement or dancing of the filaments. The physics which occurs when electric fields are used to create a series of filaments from a smooth liquid surface is not well understood. However, Mitterauer in (1987) IEEE Transactions on Plasma Science, Vol. PS-15, pp. 593–598, treated liquid emitting from a slot as a half cylinder which goes unstable at a certain perturbation of the liquid surface along its cylindrical axis. The Mitterauer theory concludes that the separation between filaments is related to the radius of the liquid cylinder. Unfortunately, although this phenomenon is observed in electrospray devices, in practice the movement of the filaments also occurs. For example, an electrically conductive metering means 11 similar to that shown in FIG. 1 but without shape forming means 15 was built. When liquid 13 was pushed to the exit of slot 20, the liquid formed a segment of a cylinder hanging at the exit of slot 20. When an electrical stress was applied to the surface of this hanging cylindrical segment of liquid a series of filaments nearly evenly spaced occurred along the liquid cylinder. However, the filaments wandered over time. Although adjustment of the liquid flow rate, sanding the metering means 11, and changing the slot dimension defined by walls 21 seemed, at times, to temporarily stop the movement of the liquid filaments, within several tens of seconds one or more of the filaments began to move from their original positions. The line of contact of the liquid with the metering means 11 on either side of the liquid cylinder segment is called the contact line. During these experiments, a very slight movement of liquid along various spots on the contact lines was occasionally observed. At times liquid appeared to enter a point along the contact line causing an advancing contact angle, and at other times liquid appeared to recede from the point causing a receding contact angle. Analysis of the kinetics of wetting, however, indicates that receding and advancing contact angles are different. Therefore, it was concluded that the local angle of attachment of the liquid to the structure was varying along the contact line, causing a variation of the local radius of curvature along the cylinder of liquid attached to the slot or emanating structure. This discovery, when applied to the Mitterauer theory was felt to explain why the filaments occasionally moved over time. Namely, if the radius varies locally, then the separation between resulting filaments will also vary along the liquid cylinder. Once flow from a filament is established, it will draw more liquid from that local area and an adjacent area will lose liquid. This loss of liquid causes the local dynamic contact angle to recede. The receding contact angle in turn effects the adjacent radius of curvature. The interaction of the local flow with the adjacent (local) dynamic contact angle effects the adjacent (local) radius of curvature and causes the undesired movement of the filaments, such as filaments 40.

In another example, liquid on a blade-like emanating structure behaves in an almost similar manner. If the liquid flows down both sides of the blade then a liquid sheet instability can develop along either flow path. The sheet instability looks similar to that of waves moving to the shore in an ocean. The variation of the wave surface along the blade causes the radius of curvature of the liquid at the blade tip to vary. Since the radius of curvature of the liquid at the blade tip defines the separation between filaments, a change in the radius of curvature produces a new separation between filaments. As a result, when the liquid sheet instability reaches the blade tip, it causes the number of filaments per unit length to change. On the other hand, if liquid is made to flow down only one side of the blade, then the liquid wraps around the blade tip and forms a contact line on the other side of the blade. For this situation both the sheet instability and the local contact angle affect the local liquid radius of curvature. Accordingly, these findings suggest that slot and blade devices cannot be used by themselves to spatially and temporally fix the filaments.

There is no known recognition of the technical reasons behind the movement of filaments on a slot, blade, or other emanating structure prior to the above disclosure. In some respect, this accounts for the structural shortcomings of other attempts at solving this filament control problem, such as through use of capillary tubes or individual teeth in order to reduce the occurrence of extra filaments. These teeth-like approaches fix the number of filaments which occur along the length of the sprayhead to one per tooth. Teeth also present another problem, since it is known that at a protruding point the number of filaments increases with increasing applied voltage above some specified voltage. Therefore, when teeth are used, the related electric field increases dramatically with the sharpness of the tooth. If the teeth are not each manufactured with the same carefully controlled radius of curvature then at a given voltage multiple filaments may occur at one tooth while only a single filament may occur at an adjacent tooth. This further teaches away from the elements of the present invention, which discloses techniques to stabilize a naturally occurring instability which eliminates unwanted filament movement along a smooth emanating surface. This stabilization results in a uniform distribution of liquid filaments which contributes to a uniform application of an electrospray coating. Furthermore, if teeth are used it severely restricts the number of filaments which can be present in a unit length of the emanating surface. On the other hand, in the present invention the applied voltage can be used to quickly and conveniently change the number of filaments to meet the desired coating need.

This invention succeeds in stabilizing the liquid radius of curvature and, therefore, stabilizing the temporal position of each filament. The local liquid radius of curvature is rendered independent of the wetting line instability or any other liquid perturbation occurring in the system by use of the structural concepts depicted in FIGS. 1-6 and FIG. 8. FIG. 5 is a sectional view of lower shaping means 15 coated with a thin amount of liquid 13. In this instance, the liquid's local radius of curvature in second portion 33 is the wire radius r' plus the thickness r'' of the liquid 13. Although liquid 13 issuing from a metering portion may still have fluctuations within the liquid, second portion 33 of lower shaping means 15 with the thin liquid layer having a thickness r'' now defines the liquid's local radius of curvature. In essence, lower shaping means 15 dampens the thin liquid fluctuations and keeps the liquid radius of curvature essentially constant at the line segment A-A', shown best in FIG. 2, which depicts the line segment of preferred maximum electrical stress.

Using the structural embodiment of the invention shown in FIG. 1, a plastic tube-shaped metering portion 11 had a slot 20 cut along the bottom. A lower shaping means 15 comprised a wire suspended beneath the slot. Extractor rods 54 were suspended proximate to the wire in substantially the same horizontal plane. The slot 20 had a length of 110 millimeters (mm), a width of 0.610 mm and a height of 10.15 min. The wire had a diameter of 2.06 mm and was positioned 105 mm above a ground plane. The extractor rods 54 each had diameters of 16 mm and were positioned at a distance of 50 mm on either side of the wire. With this physical configuration of electrospray coating head system 10 the distance between the lower terminus 22 of slot 20 and lower shaping means 15 was approximately 1 min. This permitted easy and uniform wetting of lower shaping means 15 by fluid 13. At an onset voltage of approximately 10,000 volts, the generated liquid filaments 40, such as those depicted in FIG. 4, changed in number and exhibited movement. However, as the applied voltage was raised an additional 5,000 volts the filaments stabilized and became both evenly spaced and spatially fixed. Then, as voltage was increased from 15,000 volts to 19,000 volts, the number of filaments per meter increased steadily from 262 to 459. This demonstrated a stable control of filaments per unit length and an easy adjustment method to control the number of filaments per unit length. Although the number of filaments per unit length of lower shaping means 15 is preferably controlled by regulation of applied voltage, the number may be somewhat affected by several other conditions. These other conditions include the distance between the lower shaping means and the extractor rod 54, the distance between the lower shaping means and substrate 43 and its adjacent ground 52, the viscosity of dispensed liquid 13, the conductivity of dispensed liquid 13, the dielectric constant of dispensed liquid 13, the surface tension of dispensed liquid 13, and the flow rate of liquid 13 around lower shaping means 15. Generally, more viscous solutions require a larger diameter on second portion 33 of lower shaping means 15 to achieve stable filaments along the wire.

Figure 6:
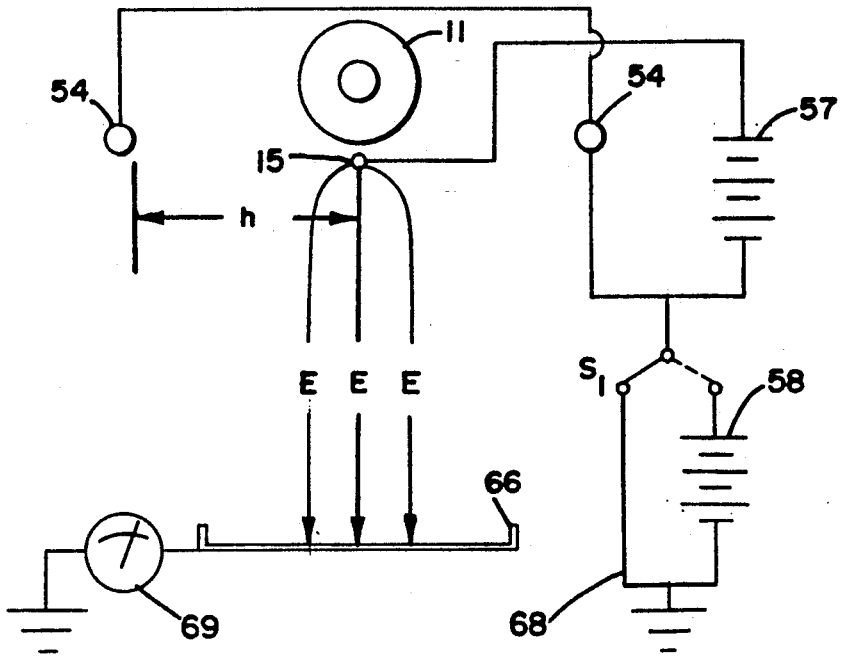
FIG. 6 is a schematic electrical diagram of an analysis set-up for the spray head assembly.
Figure 8:
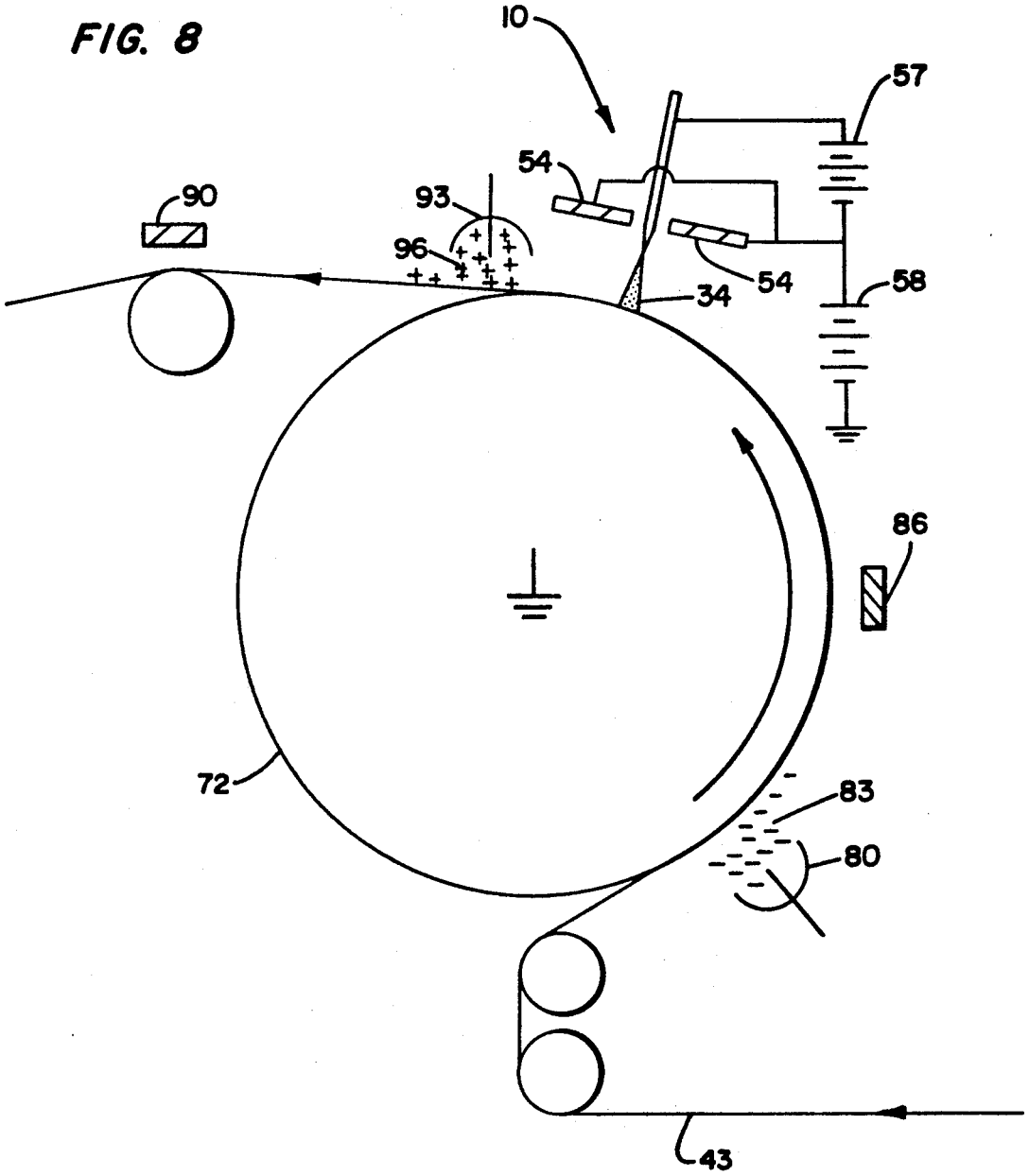
FIG. 8 is a schematic diagram of an electrospray process to create a coated substrate using the electrospray invention.

In another embodiment of an electrospray coating head system a generally triangular non-conductive plastic metering portion 11 had a conductive lower shaping means 15 comprising a wire suspended beneath, as shown in FIG. 3. Electrically conductive structures, such as extraetor rods 54 or plates (which may be flat or curved) shown in FIG. 1, FIG. 6, and FIG. 8 are positioned to create an electric field about lower shaping means 15. Electrically conductive structures 54 have a difference in potential relative to lower shaping means 15 based on the setting of a high voltage power supply such as source 57 shown in FIG. 6 and FIG. 8. Conductive extractor rods 54 may be placed parallel to lower shaping means 15 and may be variously spaced therefrom, although a distance of about 50 mm is functional using the component dimensions disclosed below in Example 1. It is recognized that a non-parallel arrangement of rods 54 would produce a non-uniform coating, and this may also be a desired outcome in certain cases. Extractor rods 54 are connected either to a high voltage electrical source 58 or to an electrical ground 68, with an optional switch S1 configuration to alternate the choice shown in FIG. 6. An electrical potential 57 is applied between lower shaping means 15 and the extractor rods 54 to create the desired electric field between the structures. The maximum electrical stress is preferably applied along line segment A-A' as discussed above in reference to FIG. 2.

Figure 4:
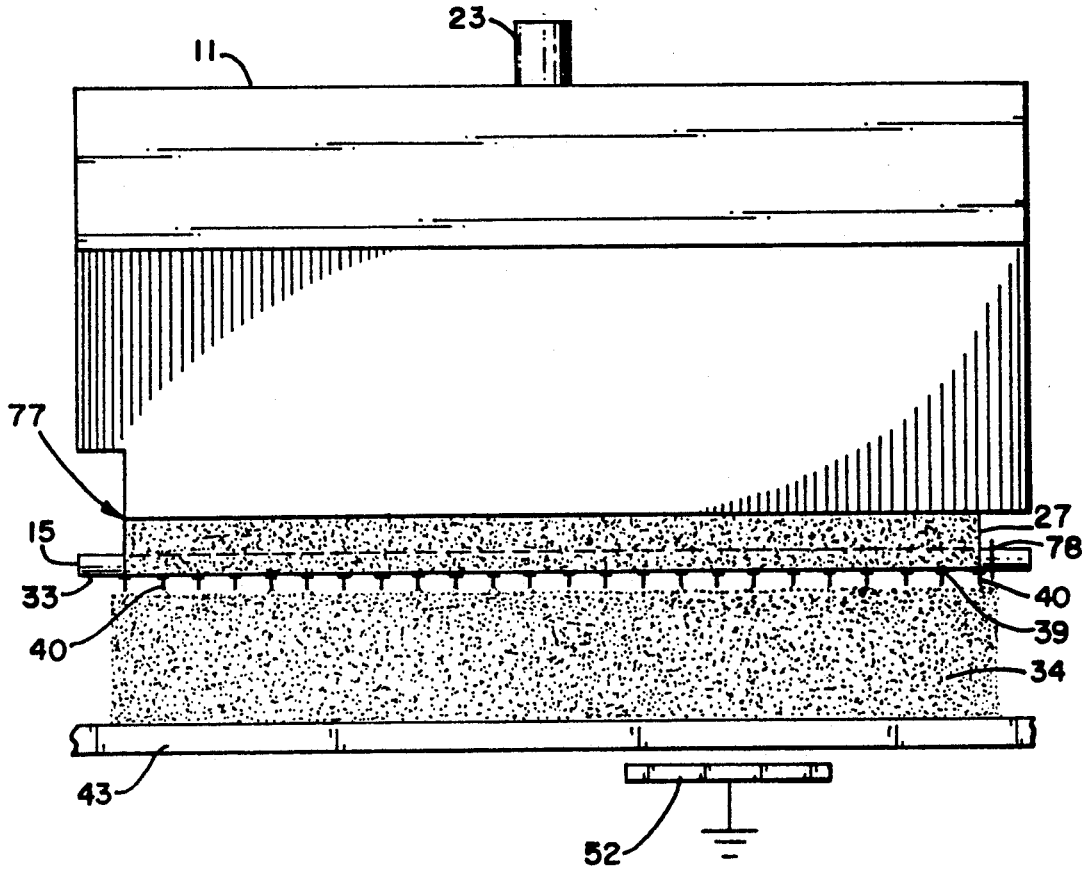
FIG. 4 is a side elevation view of a spray head assembly similar to that shown in FIG. 1 during electrospraying a fine mist of droplets onto a substrate.

Liquid 13 is then electrically stressed by the electric field into a series of filaments 40 as shown more particularly in FIG. 4. When the liquid flow rate per filament is in the electrospray range, Rayleigh jet breakup at the tips of these liquid filaments occurs and causes a fine mist of droplets 34 to be produced. Use of the techniques disclosed in this invention are particularly conducive to processes and coatings containing little or no solvent. Nevertheless, droplets 34 may be further reduced in size if evaporation of solvent from each of the droplets occurs. When this happens it is believed that the charge on the droplet will at some point exceed the Rayleigh charge limit and the droplet will disrupt into several highly charged, but stable smaller droplets. Through a succession of several disruptions, solute droplets of very small diameter are produced. In any event, the droplets 34 may be controlled and directed by electric fields to deposit on the surface of substrate 43 positioned beneath electrospray coating head system 10. Depending upon the characteristics of the liquid and operating conditions, a spreading of electrospray droplets 34 occurs on the surface of substrate 43 and a substantially continuous surface coating is produced. Alternatively, a discontinuous coating of islands can be achieved if spreading is hindered.

FIG. 6 illustrates a schematic circuit for an analysis of the electrospray process, in which a Faraday cup configuration 66 is substituted in place of substrate 43 and ground plane 52 shown in FIG. 4. Extractor rods 54 are suspended separate from but are in a horizontal plane with lower shaping means 15. FIG. 6 is further discussed below.

FIG. 8 shows a method to use sprayhead 10 to coat a substrate 43. Substrate 43, which may be smooth or rough as desired, in web form in this instance is wrapped around a large, grounded drum 72. The wrap is over a reasonable portion of the drum circumference, and this allows drum 72 to act as a common reference point for referencing differences in electrical potential. Substrate 43 (assumed non-conductive) moves under a charging device such as corotron 80 where ions 83 of one polarity are deposited on substrate 43. The charge per unit area is measured indirectly by measuring the voltage on the substrate with electrostatic voltmeter 86. The substrate then moves under sprayhead 10 where mist 34 is created by sprayhead 10. Mist 34 must be charged by source 57 to the opposite polarity of the charges deposited on substrate 43 by corotron 80. Mist 34 is then deposited on substrate 43 by the electric field created from the difference of potential between the voltage on the liquid around lower shaping means 15 and the voltage as measured by electrostatic voltmeter 86 on the surface of the substrate 43. As will be understood by those with ordinary skill in the art of electrospraying techniques, application of a differential voltage potential to the substrate will yield a differential pattern of liquid deposition. Electric fields created by the difference of potential between the voltage of extractor electrodes 54 and the substrate surface voltage as measured by electrostatic voltmeter 86 also aide in depositing mist 34 onto substrate 43. Because mist 34 is opposite in charge to the ions placed on substrate 43 by corotron 80, the substrate has a reduced charge after coating. If the amount of charge deposited by mist 34 is greater than the amount of charge deposited by corotron 80, then the substrate attains the same polarity as the mist and repels further deposition of the mist which results in a loss of control of the coating thickness. To insure that the substrate does not receive too much charge from the mist, the charge is again measured after the coating using electrostatic voltmeter 90. It is further desirable that substrate 43 not have any charge on its surface after the coating. This is accomplished using another charging device such as corotron 93 to deposit sufficient charge 96 of the same polarity as the droplets to reduce the net charge on substrate 43 back to zero. This is achieved by adjusting the source (not shown) connected to corotron 93 until electrostatic voltmeter 90 reads zero. Substrate 43 can then be sent for further processing, such as to heating and/or cure stations, to create the desired film coating. Depending upon the desired coating properties and characteristics of the liquid, application of heat can facilitate or inhibit flow of the deposited liquid on the substrate.

When substrate 43 or its surface is conductive and connected to an appropriate ground, charging devices such as corotron 80 and corotron 93 are not needed.

Referring again to FIG. 4, because of the tendency of liquid 13 to flow along the surface of metering portion 11 and surface of lower shaping means 15 (due to capillary action), the edges of curtain 27 and, consequently, the ends of sheet of droplets 34 may not be uniform with the central portions thereof. In some instances it will be preferred to provide one or more end point formation structures to attain more uniform edges by fixing a wetting line. Examples of such structures include notched or truncated edge 77 of metering portion 11 and dam 78 (e.g., a fine wire or filament wrapped around the perimeter of lower shaping means 15). Typically, a truncated edge is more preferred than a dam because a dam is typically more likely to cause the outside filaments to be heavier in the flow rate than the more centrally located filaments.

Since extractor rods 54 allow sprayhead 10 to operate at a reduced voltage they are desirable, but they are not necessary. For example, referring to FIGS. 2, 5, 6, and 8, if extractor rods 54 are absent, sprayhead 10 will still function if the voltage of source 57 is increased to create the same electrical stress along liquid segment A–A' as was created when extractor rods 54 were present.

The following illustrative examples illustrate the use of the concepts of the electrospray process of the present invention to coat various materials at different thicknesses. Unless otherwise indicated all amounts of the constituents in the liquid are in parts by weight.

EXAMPLE 1

This example shows the effect of the applied voltage on the number of filaments formed per meter with electrospray coating head system 10. The solution used was a silicone acrylate composition described in co-pending patent application Ser. No. 07/672,386, titled Radiation Curable Vinyl/Silicone Release Coating, filed Mar. 20, 1991. The solution was prepared by mixing 72.5 parts by weight of isooctyl acrylate, 10 parts of hexanediol diacrylate, 7.5 parts of trimethylolpropane tri($\beta$-acryloxypropionate), 5 parts of acrylic acid, and 1.5 parts of 5000 molecular weight acrylamidoamido siloxane. To this was added 2 parts by weight of DAROCURE 1173, 2-hydroxy-2-methyl-1-phenyl-propan-1-one, a free-radical UV initiator by Ciba Geigy, and 5 parts of methanol. The solution's physical properties pertinent to electrospray were a conductivity of 1.5 microsiemens per meter ($\mu$S/m), a viscosity of 6 millipascal-seconds (mPa-s), a dielectric constant of 11.6, and a surface tension of 24.5 millinewtons per meter (mN/m).

An electrospray coating head system 10 similar to that shown in FIG. 1 was used which consisted of a plastic tube with a slot cut along the bottom, a wire suspended beneath the slot and extractor rods suspended parallel to the wire in approximately the same horizontal plane. The slot had a length of 110 mm, a width of 0.610 mm, and a height of 10.15 mm. The wire had a diameter of 2.06 mm and was positioned 105 mm above the ground plane. The extractor rods each had diameters of 16 mm and were positioned on either side of the wire at a distance h of 50 mm from the wire as shown in FIG. 6.

Figure 7:
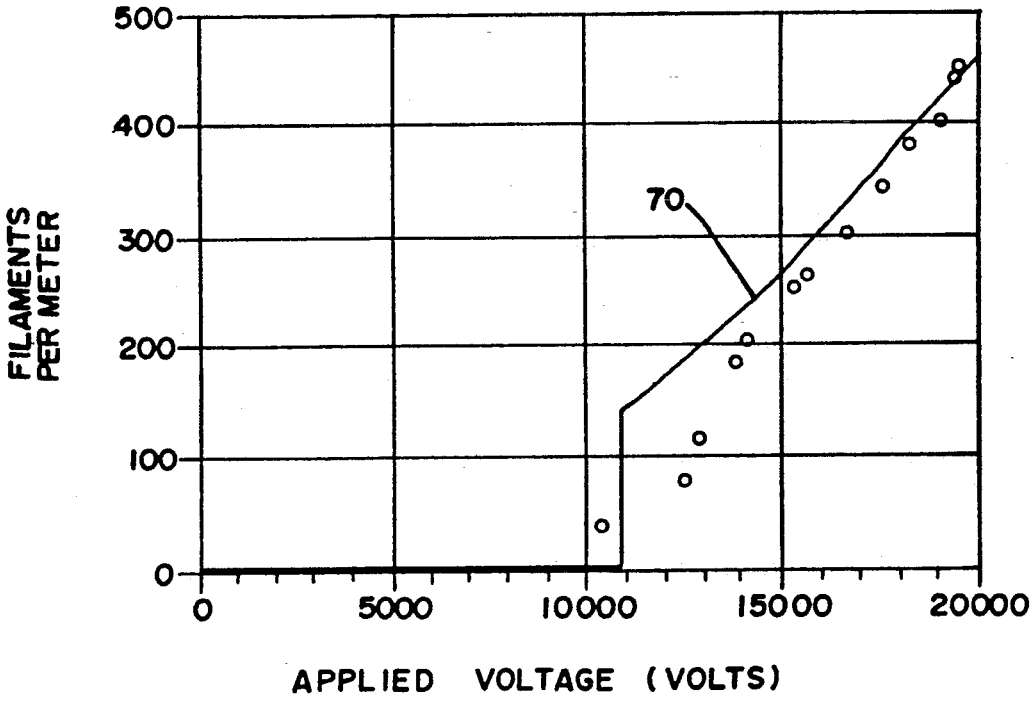
FIG. 7 is a data graph which shows a proportional relationship between filaments per meter and a function of the applied voltage.

Electrospray coating head system 10 was mounted above a large, flat metal pan 66, as shown in the schematic circuit drawing of FIG. 6. The pan was placed on a sheet of 6.4 mm plexiglass to insulate it from ground. A Keithley model 485 picoammeter 69 was connected from the pan to ground. This allowed the pan to act as a Faraday cup and to create an electric field path E between the liquid around wire 15 and pan 66. A negative 20 kV Glassman power supply Model PS/WG-20N15-DM was connected to the wire. The extractor electrodes 54 were held at ground potential. Filaments were counted at various potentials. The results are shown as data points in the graph of FIG. 7. As will be understood source 57 and source 58 can be operated in whichever polarity is desired.

The filament density was obtained by counting the filaments along the wire and dividing by the length of wire that contained the filaments. A relationship in which the filaments per meter were roughly proportional to a function approximating the square of the applied voltage is shown as the solid line 70 on the graph. Near the voltage where the induced instability first results in filaments (around 10,000 volts), the filaments changed in number and danced around. Within 5000 additional volts, the filaments had stabilized to being generally evenly spaced and spatially fixed. Increasing the voltage above 15,000 volts allowed control of the number of filaments. The data points of the stabilized filaments are in good agreement with the curve predicting a linear relationship between the number of filaments per meter and a function approximating the square of the applied voltage. U.S. Pat. No. 4,748,043 teaches that each liquid has a specific flow rate range at which a stable single filament occurs in the electrospray operation. In a needle or tooth-type electrospray head the number of filaments per unit length is fixed by the number of these teeth-like protrusions. However, with the present invention, the flow rate range of the system is not so restricted and the number of filaments per unit length can be easily controlled by a simple adjustment of the voltage level. Furthermore, for many liquids, when a filament is produced in the electrospray mode from a smooth surface, the high end of its electrospray flow rate range is increased by a factor of two or more from the same liquid forming a filament from a needle or sharp tooth-like structure.

EXAMPLE 2

This example describes the use of the slot and wire electrospray coating process to deposit a solution to form a thick coating, between 6 and 9 micrometers (um), on a rough surface. The solution to be coated was prepared by mixing 90 parts by weight of a cycloaliphatic epoxy (tradename ERL-4221 from Union Carbide) with 10 parts of hexanedioldiacrylate (tradename SR-238 by Sartomer Inc. in Exton, Pa.), adding 0.25 pans of 2,2-dimethyl-2-phenylacetophenone, a deep cure photoinitiator (tradename IRGOCURE 651 by Ciba-Geigy), and 0.25 pans of cyclopentadienyl cumene iron II phosphorous hexafluoride, a visible light cure photoinitiator (tradename IRGOCURE 261 by Ciba-Geigy), and diluting to 85% weight solids with toluene (Catalog No. 32, 055-2 by Aldrich in Milwaukee, Wis.). The solution's physical properties pertinent to electrospray were a conductivity of 70 μS/m, a viscosity of 29 mPa-s, a dielectric constant of 11, and a surface tension of 27 mN/m. The solution was introduced into electrospray coating head system 10 using a Sage Model 355 syringe pump available from Sage Instruments of Cambridge, Mass.

The slot had a uniform width of approximately 610 μm and a length of 102 mm. A high voltage of positive 19.5 kV was applied to the wire and positive 6 kV was applied to the extractor rods. The extractor rods were 6 mm in diameter and 25 mm from the wire. The wire was 3.2 mm in diameter, approximately 2 mm beneath the slot, and 90 mm above the film surface of a transport mechanism. The transport consisted of a non-conductive carrier web on top of a moving metal belt. Sample sheets or rolls of material could be placed or fed onto this belt-plus-carrier-web transport configuration. The metal belt was held at ground potential.

A roll of 76 μm thick polyethylene terethalate (PET) film was resin coated and then loosely impregnated with a thin layer of particles having an average diameter of 12 μm. Strips of this material 102 mm by 914 mm were fed on top of the carrier web and into the transport mechanism. The rough surface of the strip was charged under a corona charger to a potential of approximately negative 2 kV. The web speed was held fixed at 6.1 meters/min. Two pump flow rates were used, 295 ml/hr and 443 ml/hr. The flow rate per filament was obtained by dividing the total pump flow rate into the metering portion by the total number of filaments.

When the high voltage was applied, ten filaments formed over 95 mm of wire length that was beneath the slot. Solution flow rates per filament were 29.5 ml/hr and 44.3 ml/hr and resulted in coating thicknesses of 6 μm and 9 μm, respectively. In this example, use of a thick wire resulted in 105 filaments per meter. The coated strips were then passed under a medium pressure mercury lamp and exposed to 610 Joules per square meter ($J/m^2$) of 254 nanometers (nm) ultraviolet radiation.

EXAMPLE 3

This example describes how the process is used to make a thin, easy-release, coated surface on a smooth plastic film for adhesive applications. Two solutions were coated. The first solution was prepared by mixing the following commercially available liquids: 40 parts by weight of an epoxysilicone (tradename UV9300 Solventless UV Release Polymer by GE Silicones, a division of General Electric Company of Waterford, N.Y.), 20 parts of 1,4-cyclohexanedimethanol divinyl ether (tradename Rapi-Cure CHVE Reactive Diluent by GAF Chemicals Corporation in Wayne, N.J.), 15 parts of limonene monoxide (by Atochem of Philadelphia, Pa.), and 25 parts of food-grade d-limonene (by Florida Chemical Co. Inc. of Lake Alfred, Fla.). To this was added 3 parts by weight of an iodonium salt (tradename UV9310C Photoinitiator by GE Silicones). The mixture was designated as 40/20/15/25+3. The second solution was prepared by mixing the above liquids in the following proportions: 25/20/15/40+3. The first solution's physical properties pertinent to electrospray were a conductivity of 11 μS/m, viscosity of 19 mPa-s, dielectric constant of 7.5, and surface tension of 24 mN/m. The second solution's physical properties pertinent to electrospray were a conductivity of 11 μS/m, viscosity of 9 mPa-s, dielectric constant of 7.6, and surface tension of 24 mN/m.

An electrospray coating head system 10 was used which consisted of a hollowed-out plastic block having a triangular shaped cross section, similar to that shown in FIG. 3, with a slot cut along the bottom edge, and a wire suspended beneath the slot and extractor rods suspended parallel to the wire in the same horizontal plane. The slot has a length of 305 mm, a width of 0.610 mm, and a height of 19 mm. The wire had a diameter of 2.4 mm and was positioned 2 mm from the slot for the more viscous solution and 1 mm for the second, less viscous, solution. The extractor rods each have a diameter of 6.4 mm and are positioned at a distance of 25 mm on either side of the wire. The solution to be coated was introduced into the electrospray coating head system 10 using a MicroPump Model 7520-35 and a magnetically coupled gear pump head available from Cole-Palmer Instrument Company of Chicago, Ill., as catalog numbers N-07520-35 and A-07002-27, respectively.

A high voltage of positive 25 kV was applied to the wire with a High Voltage DC Power Supply Model R60A by Hipotronics of Brewster, N.Y. The extractor rods were grounded. The wire was 90 mm above the film surface to be coated as it passed over the surface of a free-spinning, conductive, 610 mm diameter metal drum 72, shown in FIG. 8. This coating station allowed rolls of plastic film, paper or metal foil to be coated. Furthermore, the previously mentioned rolls could be used as carrier webs on which sheet samples could be placed. The metal drum was held at ground potential.

A 305 mm wide roll of 36 μm thick PET film was fed through the coating station. The film surface was charged to a potential of approximately negative 1.5 kV sufficient to pin the film to the metal drum and film sheets to the carrier web. The pump flow rate was held constant at 5.5 ml/min out of a 305 mm long slot. The solution wetted 305 mm of the wire beneath the slot. Web speeds of 9.1, 27.4, and 45.7 meters/min. were used. Estimated coating thicknesses at the different speeds were 2.0, 0.7, and 0.4 μm respectively.

The coated film was then exposed to heat and ultraviolet radiation to convert the coating into a durable release surface. The coated film was passed through a 2.4 meter long air impingement oven with an estimated heat transfer coefficient of between 62.8 Joules per second per square meter per degree Celsius (J/(s $m^2$ C.)) and 125.5 J/(s $m^2$ C.). Three air temperatures were used in the oven for each solution (35° C., 42° C., and 60° C. for the first solution and 24° C., 44° C. and 59° C. for the second). The residence times in the oven at the three speeds were 16, 5.3, and 3.2 seconds. The coated film was estimated to have reached the oven temperature within 3.2 seconds at the lower heat transfer coefficient estimate and 1.6 seconds at the higher estimate. The coated film then passed under a medium pressure mercury vapor lamp and exposed to 880, 290, and 180 J/$m^2$ (at 9.1, 27.4, and 45.7 meters per rain respectively) of 254 nm radiation.

The subsequent cured coatings were heat aged for 3 days at 65° C. and 50% relative humidity against tapes with either a natural rubber/resin adhesive (No. 232 Scotch TM Masking Tape from Minnesota Mining and Manufacturing Company (3M) St. Paul, Minn.) or an acrylic adhesive (No. 810 Scotch TM Magic TM Tape from 3M. The tapes were peeled off the samples at 180 degrees at a rate 2.286 m/min after being out of the oven for at least 4 hours in a room where the temperature and humidity were held constant at 22.2° C. and 50% relative humidity. No significant loss in re-adhesion was observed. The release values in Newtons per decimeter tape width for the different epoxysilicone concentrations and web temperatures at the three speeds (9.1, 27.4, and 45.7 meters per min, identified as A, B, and C, respectively) were:

| Condition | | | | | | | |
|---|---|---|---|---|---|---|---|
| EpS | Web Temp | Masking Tape | | | Magic TM Tape | | |
| % | °C. | A | B | C | A | B | C |
| 40 | 35 | 1.6 | 3.1 | 5.8 | 0.8 | 1.7 | 5.6 |
| 40 | 42 | 1.5 | 1.7 | 4.1 | 0.6 | 0.5 | 3.2 |
| 40 | 60 | 1.8 | 0.9 | 2.5 | 0.3 | 0.1 | 1.1 |
| 25 | 24 | 1.9 | 3.2 | 3.9 | 1.3 | 3.9 | 5.6 |
| 25 | 44 | 1.1 | 2.6 | 2.1 | 0.8 | 0.8 | 1.3 |
| 25 | 59 | 1.8 | 1.2 | 1.9 | 1.2 | 0.7 | 1.0 |

As time is decreased between the coating application step and the coating cure step, it is advantageous to use heat in order to obtain easy release performance with these solution compositions.

The number of filaments per meter were not counted during this experiment but were counted in earlier experiments where similar head geometries were used. For example, in the earlier experiments when a voltage of positive 24 kV was applied to the first solution, approximately 90 filaments formed over 305 mm of wire length that was beneath the slot. The pump flow rate was 5.5 ml/min which gave a calculated solution flow rate per filament of 3.7 mil/hr. When a voltage of positive 22 kV was applied to the second solution, approximately 80 filaments formed. The pump flow rate was 9.5 ml/min which gave a calculated flow rate per filament of 7.1 ml/hr.

EXAMPLE 4

This example describes how the process is used to make a thin, easy-release, coated surface on a rough substrate for an adhesive application. The solution to be coated was the same as the first solution of Example 3. The method of applying the solution to a substrate was also the same as described in Example 3.

A 102 mm by 7.6 m rough-surfaced strip of glass bead impregnated resin, adhesive coated on the underside and loosely adhered to 305 mm wide silicone coated paper, was placed on a 330 mm wide roll of 61 μm thick PET carrier film and fed through the coating station. The rough surface and the exposed silicone coated paper were charged to a negative potential of approximately 1.5 kV. The pump flow rate was held constant at 5.5 ml/min out of a 305 mm long slot. Solution wetted 330 mm of the wire beneath the slot. The web speed was constant at 15.2 meters per min. The coating thickness was estimated at 1.2 μm.

The coated film was then exposed to heat and ultraviolet radiation to convert the coating into a durable release surface. The coated film was passed through a tunnel 25 mm in height, 356 mm in width, and 1.83 m long. A hot air blower (Model 6056 by Leister of Switzerland), with an exit air temperature at the nozzle of 187° C., fed air into the tunnel counter-current to the web movement. The air temperature exiting the tunnel was approximately 100° C. and the web temperature exiting the tunnel was estimated to be approximately 50° C. based on infrared measurement of the polyester film at similar conditions using a device similar to a Mikron M90 Series Portable IR Thermometer by Mikron Instrument Company, Inc., of Wyckoff, N.J. The coated film was then passed under a medium pressure mercury vapor lamp and exposed to 400 J/m$^2$ of 254 nm radiation.

The subsequent cured coatings exhibited satisfactory release and readhesion performance characteristics when tested against the same natural rubber/resin adhesive that was on the bottom of the coated substrates.

EXAMPLE 5

This example describes the use of this process to dispense a primer. The solution to be coated was prepared by mixing 95 parts by weight of hexanedioldiacrylate and 5 parts of benzophenone (Catalog No. B930-0 by Aldrich), and diluting this solution to 90% by weight by adding methanol (Catalog No. 17933-7 by Aldrich). The solution's physical properties pertinent to electrospray are a conductivity of 2.6 μS/m, viscosity of 9 mPa-s, dielectric constant of 10.1 and surface tension of 34.2 mN/m. The solution was introduced into electrospray coating head system 10 using a Sage Model 255 syringe pump. The electrospray coating head system was mounted above a large, flat metal pan 66 as shown in FIG. 6. The slot had a uniform width of 410 μm and a length of 76 mm. The Hipotronics power supply of Example 3 was used to apply a voltage of positive 24 kV to the wire. The wire was 1.7 mm in diameter, 762 μm below the slot and 90 mm above the metal pan. The extractor rods 54 were 6 mm in diameter, 25 mm from the wire and were at ground. As the solution flowed out of the slot, it coated an 89 mm segment of wire.

The following total number of filaments and flows per filament were achieved as the total flow rate into the spray head was increased from 1.36 to 13.56 ml/min (identified as rates A, B, C, and D, respectively):

| | Total Flow ml/min | Total Filaments | Flow per Filament ml/hr/filament |
|---|---|---|---|
| A | 1.36 | 12 | 6.8 |
| B | 1.97 | 12 | 9.8 |
| C | 5.09 | 11 | 27.8 |
| D | 13.56 | 9 | 90.4 |

As the above flow per filament increased, the filament length appeared to become longer and the filament diameter larger before the filament broke up into droplets. The lower two flow rates (A and B) were in the electrospray range and the higher two flow rates (C and D) were approaching and in the harmonic spray range, respectively.

Various modifications and alterations of this invention will become apparent to those skilled in the art without departing from the scope and spirit of this invention.

We claim:

1. An electrospray coating head system for use in an electrospray coating process, the coating head system comprising:

a) a metering portion for dispensing liquid to a lower shaping means; and b) a lower shaping means disposed below said metering portion such that dispensed liquid flows from said metering portion onto said lower shaping means so as to surround said lower shaping means, creating a layer having a single continuous and substantially constant local radius of curvature of the dispensed liquid around the lower shaping means so that the number and position of filaments of said liquid extending from the lower shaping means is variable depending upon the magnitude of a potential applied to the surface of the liquid surrounding the lower shaping means, and so that at a specific potential said liquid filaments are spatially and temporally fixed to permit generation of a uniform mist of highly charged droplets.

2. The coating head system of claim 1 in which the metering portion comprises an elongated member with internal walls defining a liquid reservoir cavity for receiving liquid and a slot extending from the liquid reservoir cavity to an external aperture along a length of the member.

3. The coating head system of claim 1 in which the lower shaping means comprises a portion of an elongated wire-shaped member.

4. The coating head system of claim 3 in which the wire-shaped member comprises a wire.

5. The coating head system of claim 4 in which the wire is electrically conductive.

6. The coating head system of claim 1 in which the metering portion comprises an elongated blade-shaped member comprising opposing side walls having an upper portion and a base, the opposing side walls providing at least one flow path for a continuous flow of liquid to be dispensed from the upper portion to the base and onto the lower shaping means as a uniform and uninterrupted liquid curtain in contact with the lower shaping means.

7. The coating head system of claim 1 in which the metering means is removable and replaceable within the coating head.

8. The coating head system of claim 1 in which the lower shaping means is removable and replaceable with a different lower shaping means within the coating head system.

9. The coating head system of claim 8 in which each different lower shaping means comprises a different radius of curvature.

10. The coating head system of claim 1 further comprising end point formation structure located on the lower shaping means, the end point formation structure fixing a wetting line on opposing ends of the lower shaping means.

11. The coating head system of claim 1 further comprising end point formation structure located on the metering means, the end point formation structure fixing a wetting line on opposing ends of the metering means.

12. The coating head system of claim 1 further comprising at least one electrically conductive structure having a lesser potential than the liquid surrounding the lower shaping means, the structure being positioned proximate the lower shaping means.

13. The coating head system of claim 12 in which the conductive structure comprises a conductive rod.

14. The coating head system of claim 12 in which the conductive structure comprises a conductive plate.

15. The coating head system of claim 13 or claim 14 in which the conductive structure has a non-conductive outer surface coating.

16. A method of variably controlling the uniform emission of a liquid being applied as a coating material in an electrospray coating process, comprising the steps of:

a) providing a metering portion for dispensing liquid to a lower shaping means;

b) positioning lower shaping means below said metering portion such that dispensed liquid flows from said metering portion onto said lower shaping means so as to surround said lower shaping means, creating a layer having a single continuous and substantially constant local radius of curvature of the dispensed liquid around the lower shaping means so that the number and position of filaments of said liquid extending from the lower shaping means is variable depending on the magnitude of a potential applied to the surface of the liquid surrounding the lower shaping means; and c) adjusting the potential applied to the surface of the liquid so that a specific potential produces a desired number and position of filaments of said liquid and so that at a specific potential said liquid filaments are spatially and temporally fixed to permit generation of a uniform mist of highly charged droplets.

17. The method of claim 16 in which the droplet number density of the uniform mist is controlled by regulating the potential applied to the surface of the liquid surrounding the lower shaping means.

18. A method of variably controlling the emission of a liquid being applied as a coating material in an electrospray coating process, comprising the steps of:

a) providing a metering portion for dispensing liquid to a lower shaping means;

b) positioning lower shaping means below said metering portion such that dispensed liquid flows from said metering portion onto said lower shaping means so as to surround said lower shaping means, said lower shaping means creating a layer having a single continuous and substantially constant local radius of curvature of the dispensed liquid around the lower shaping means so that the number and position of filaments of said liquid extending from the lower shaping means is variable depending on the magnitude of a potential applied to the surface of the liquid surrounding the lower shaping means;

c) adjusting the potential applied to the surface of the liquid so that a specific potential produces a desired number and position of filaments of said liquid and so that at a specific potential said liquid filaments are spatially and temporally fixed to permit generation of a uniform mist of highly charged droplets; and d) directing the flow of the mist toward selected deposition sites on a movable substrate.

19. The method of claim 18 further comprising heating said liquid after deposition on said substrate.

20. The method of claim 18 further comprising curing said liquid after deposition on said substrate.

* * * * *

UNITED STATES PATENT AND TRADEMARK OFFICE

CERTIFICATE OF CORRECTION

PATENT NO. : 5,326,598

DATED : July 5, 1994

INVENTOR(S) : Albert E. Seaver et al.

It is certified that error appears in the above-identified patent and that said Letters Patent is hereby corrected as shown below:

In Column 5, Line 52, the number "$10^{-1}$" should read --$10^{-3}$--.

In Column 9, Line 63, "10.15 min." should read--10.15mm--.

In Column 10, Line 2, "1 min." should read --1 mm--.

In Column 13, Line 61, the word "pans" should read --parts--.

In Column 15, Line 54, the word "rain" should read --min--.

Signed and Sealed this

Twenty-eight Day of March, 1995

*Attest:*

*Attesting Officer*

BRUCE LEHMAN

*Commissioner of Patents and Trademarks*